US008083228B2

(12) United States Patent
deJong et al.

(10) Patent No.: US 8,083,228 B2
(45) Date of Patent: Dec. 27, 2011

(54) CLOSED LOOP LATERAL AND SKEW CONTROL

(75) Inventors: Joannes N. M. deJong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 21 days.

(21) Appl. No.: 12/647,765

(22) Filed: Dec. 28, 2009

(65) Prior Publication Data

US 2011/0156345 A1 Jun. 30, 2011

(51) Int. Cl.
*B65H 7/02* (2006.01)

(52) U.S. Cl. ..... 271/228; 271/227

(58) Field of Classification Search ..... 271/226, 271/227, 228

See application file for complete search history.

(56) References Cited

U.S. PATENT DOCUMENTS

| | | | | |
|---|---|---|---|---|
| 4,971,304 | A * | 11/1990 | Lofthus | 271/227 |
| 5,678,159 | A | 10/1997 | Williams et al. | |
| 5,697,608 | A | 12/1997 | Castelli et al. | |
| 5,887,996 | A | 3/1999 | Castelli et al. | |
| 6,168,153 | B1 * | 1/2001 | Richards et al. | 271/227 |
| 6,866,260 | B2 | 3/2005 | Williams et al. | |
| 7,422,211 | B2 | 9/2008 | Dejong et al. | |
| 7,593,684 | B2 * | 9/2009 | De Jong et al. | 399/395 |
| 7,712,737 | B2 * | 5/2010 | Elliot | 271/228 |
| 7,712,738 | B2 * | 5/2010 | Elliot | 271/228 |
| 7,717,533 | B2 * | 5/2010 | De Jong et al. | 347/16 |
| 7,748,708 | B2 * | 7/2010 | Elliot | 271/228 |
| 2007/0023994 | A1 * | 2/2007 | Mandel et al. | 271/226 |
| 2007/0048053 | A1 | 3/2007 | De Jong et al. | |
| 2008/0012214 | A1 * | 1/2008 | Elliot | 271/227 |
| 2008/0237975 | A1 | 10/2008 | de Jong et al. | |
| 2009/0121419 | A1 * | 5/2009 | deJong et al. | 271/228 |
| 2010/0327517 | A1 * | 12/2010 | Krucinski | 271/227 |
| 2011/0049793 | A1 * | 3/2011 | deJong et al. | 271/227 |

* cited by examiner

*Primary Examiner* — Kaitlin Joerger
(74) *Attorney, Agent, or Firm* — Hoffmann & Baron, LLP

(57) ABSTRACT

According to aspects illustrated herein, a method, a system, and a printmaking device for performing closed loop lateral and skew control of a sheet is provided. The printmaking device includes a feed path, printing module, and sheet registration system. First, the feed path moves the sheet in a process direction past the lateral sensor. Next, the sheet is registered by measuring a lateral position of one side edge of the sheet at a fixed reference using the lateral sensor and determining a lateral position error of the sheet using the lateral position measurement. After that, a sheet angular velocity is calculated based on the lateral position error using the registration controller. Then, the lateral position error is corrected using the at least one pair of registration nips to adjust the sheet by applying the sheet angular velocity to the sheet.

25 Claims, 9 Drawing Sheets

CLOSED LOOP LATERAL AND SKEW CONTROL

TECHNICAL FIELD

This disclosure relates to apparatus, systems, and methods of accurately registering a sheet in a media handling assembly, such as a printing system or a printmaking device. The disclosure specifically provides a method for closed loop lateral control of a sheet in an agile registration system.

BACKGROUND

Agile registration systems receive a mis-registered sheet at the input and deliver the sheet registered to a downstream "agile" registration datum, such as a photoreceptor or a drum. Typically, agile registration systems provide for approximately 2 or 3 degrees of movement between input and output. FIG. 1 shows an example of an agile registration system 10. In order to deliver the sheets downstream, the agile registration system 10 uses stationary nips 12, 14 to impart x-direction velocity vectors $v_0$ (16) and $v_1$ (18) on a sheet 20. The average of the velocity vectors 16, 18 $(v_1+v_0)/2$ provides an x-direction process direction) motion to the sheet. The difference between the velocity vectors 16, 18 $(v_1-v_0)$ provides a rotation of the sheet 20. The sheet 10 is transported downstream and adjusted along a feed path 22 prior to entering a device.

When the sheet 20 enters the nips 12, 14 of the agile registration system 10, the velocities are set equal to the sheet velocity of the sheet 20 along the upstream feed path 22 to ensure correct hand-off between the sheet 20 and the upstream feed path 22 of the sheet 20. Agile registration begins after a sensor detects the sheet 20. The system 10 shown includes two lead edge sensors 24, 26 configured to report the time-of-arrival t0 and the process position $x_0$ (28) and angle $\beta_0$ (30) of the sheet 20. The system 10 further includes a lateral sensor 32 reports the lateral position $y_0$ (34) of the sheet 20. In many cases, the lead-edge-center 28 or lead-edge-side 34 is considered the point that is being registered since simple geometric calculations may be used to yield values for the initial conditions of the registration point from sensor measurements.

To ensure the paper is delivered at the correct time and in the correct position, velocity profiles of both nips 12, 14 must be computed. The velocity profiles v1($t$) and v0($t$) at the a time, $t=t_f$, and may be represented by $x_f$, $y_f$, and $\beta_f$, with the velocity at the delivery location usually matching the velocity of the downstream device.

FIG. 2 (40) provides the system 10 with a sample trajectory 42 of the sheet 20 along the feed path 22 from arrival 44 of the sheet 20 at the nips 12, 14 during agile registration to the delivery 46 of the sheet 20 at the downstream device. Note, the trajectory of sheet 20 through the nip center 48 is curved, illustrating the correction to the position of the sheet 20 over time. The position of the sheet 20 is corrected to be in the proper lateral position by changing the lateral position and the skew of the sheet 20. As disclosed in U.S. Pat. No. 5,887,996 to Castelli et al., a skew in the sheet 20 results in both a skew error and lateral error. Hence, a lateral controller may be used to move the sheet 20 such that the skew error and lateral error are corrected.

Current strategies for sheet registration use sensors to take snap shots of the sheet as the agile registration begins, as shown on the trajectory as the arrival 44 of the sheet 20, to determine the appropriate location of the sheet at the delivery location, as shown on the trajectory as the delivery 46 of the sheet 20. The problem with such systems is that there is no verification or follow-up sensoring to ensure the sheet 10 really ends up at the delivery location in the correct position. When inaccuracies in any of the programmed inboard and outboard nip velocities and/or input sheet position result in registration errors in the process, lateral, and skew measurements. Thus, there is a need for a method of reducing the lateral error overtime using a single low-cost sensor.

SUMMARY

According to aspects illustrated herein, there is provided a printmaking device for performing closed loop lateral and skew control of a sheet using a single lateral sensor in a sheet registration system is provided. The printmaking device includes a feed path, a printing module, and a sheet registration system. The feed path is adapted to move the sheet of paper, the sheet including a first edge, a second edge and a first side edge and a second side edge therebetween. The first edge is approximately parallel to the second edge. The printing module is configured to print an image on the sheet. The sheet registration system is along the feed path and includes a lateral sensor, a registration controller, and at least one pair of registration nips. The lateral sensor is configured to measure the lateral position of the first side edge of the sheet at a fixed reference along the feed path to determine a lateral position error of the first side of the sheet. The registration controller is configured to calculate an angular velocity based on a lateral position error. The registration controller is operatively connected to the lateral sensor. The at least one pair of registration nips are along the feed path and operatively connected to the registration controller. The at least one pair of registration nips are configured to apply the angular velocity to the sheet. The feed path moves a first side of the sheet in a process direction past the lateral sensor and the first side of the sheet is registered by: measuring a first lateral position of the first side edge of the sheet at a first fixed reference along the feed path using the lateral sensor; determining a first lateral position error of the first side of the sheet using the first lateral position measurement; calculating a first sheet angular velocity based on the lateral position error using the registration controller; correcting the lateral position error using the at least one pair of registration nips to adjust the sheet by applying the first sheet angular velocity to the sheet.

According to other aspects illustrated herein, there is provided a method for performing closed loop lateral and skew control of a sheet using a single lateral sensor in a sheet registration system. The method includes the following steps. Moving the sheet along a feed path in a process direction to the sheet registration system. The sheet having a first edge, a second edge, and a first side edge and a second side edge therebetween. Measuring a first lateral position of the first side edge of the sheet at a first fixed reference along the feed path using the lateral sensor. Determining a first lateral position error of the first side of the sheet using the first lateral position measurement. Calculating a first sheet angular velocity based on the lateral position error. Correcting the lateral position error by applying the first sheet angular velocity to adjust the sheet.

According to other aspects illustrated herein, there is provided a system for performing closed loop lateral and skew control of a sheet using a single lateral sensor. The system includes a feed path, a lateral sensor, a registration controller, and at least one pair of registration nips. The feed path is configured to move the sheet in a process direction. The sheet having a first edge, a second edge, and a first side edge and a second side edge therebetween. The lateral sensor is configured to measure the lateral position of the first side edge of the sheet at a fixed reference along the feed path to determine a lateral position error of the first side edge. The registration controller is configured to calculate an angular velocity based on a lateral position error. The registration controller is operatively connected to the lateral sensor. The at least one pair of registration nips along the feed path and operatively connected to the registration controller. The at least one pair of registration nips configured to apply the angular velocity to the sheet. The feed path moves a first side of the sheet in a process direction past the lateral sensor. The first side of the sheet is registered by: measuring a first lateral position of the first side edge of the sheet at a first fixed reference along the feed path using the lateral sensor; determining a first lateral position error of the first side of the sheet using the first lateral position measurement; calculating a first sheet angular velocity based on the lateral position error using the registration controller; correcting the lateral position error using the at least one pair of registration nips to adjust the sheet by applying the first sheet angular velocity to the sheet.

Additional features and advantages will be readily apparent from the following detailed description, the accompanying drawings, and the claims. It is to be understood, however, that the drawings are designed as an illustration only and not as a definition of the limits of the disclosure.

BRIEF DESCRIPTION OF THE DRAWINGS

Like reference symbols in the various drawings indicate like elements.

DETAILED DESCRIPTION

Figure 1:
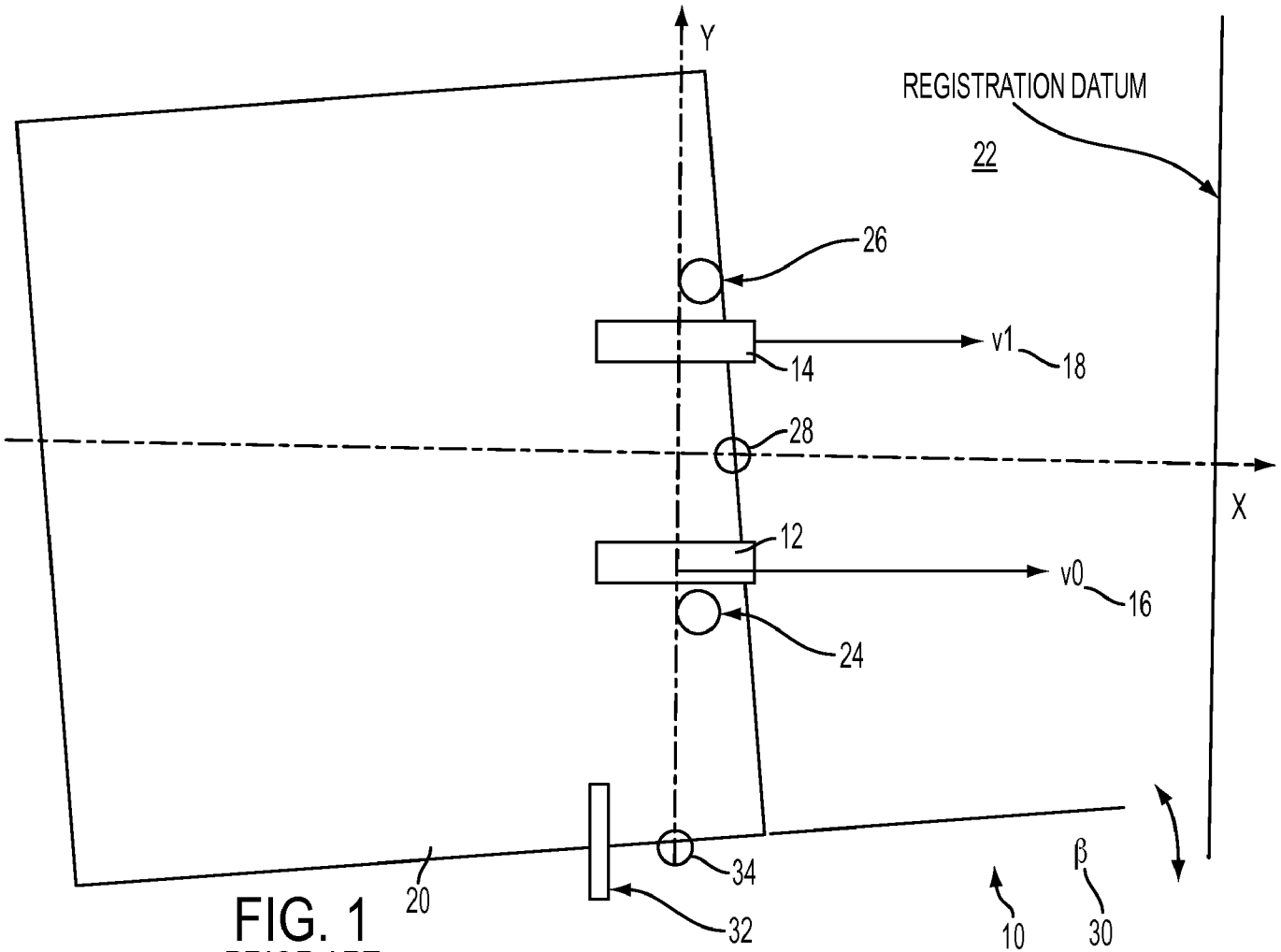
FIG. 1 PRIOR ART
FIGS. 1-2 illustrate prior art registration systems.
Figure 2:
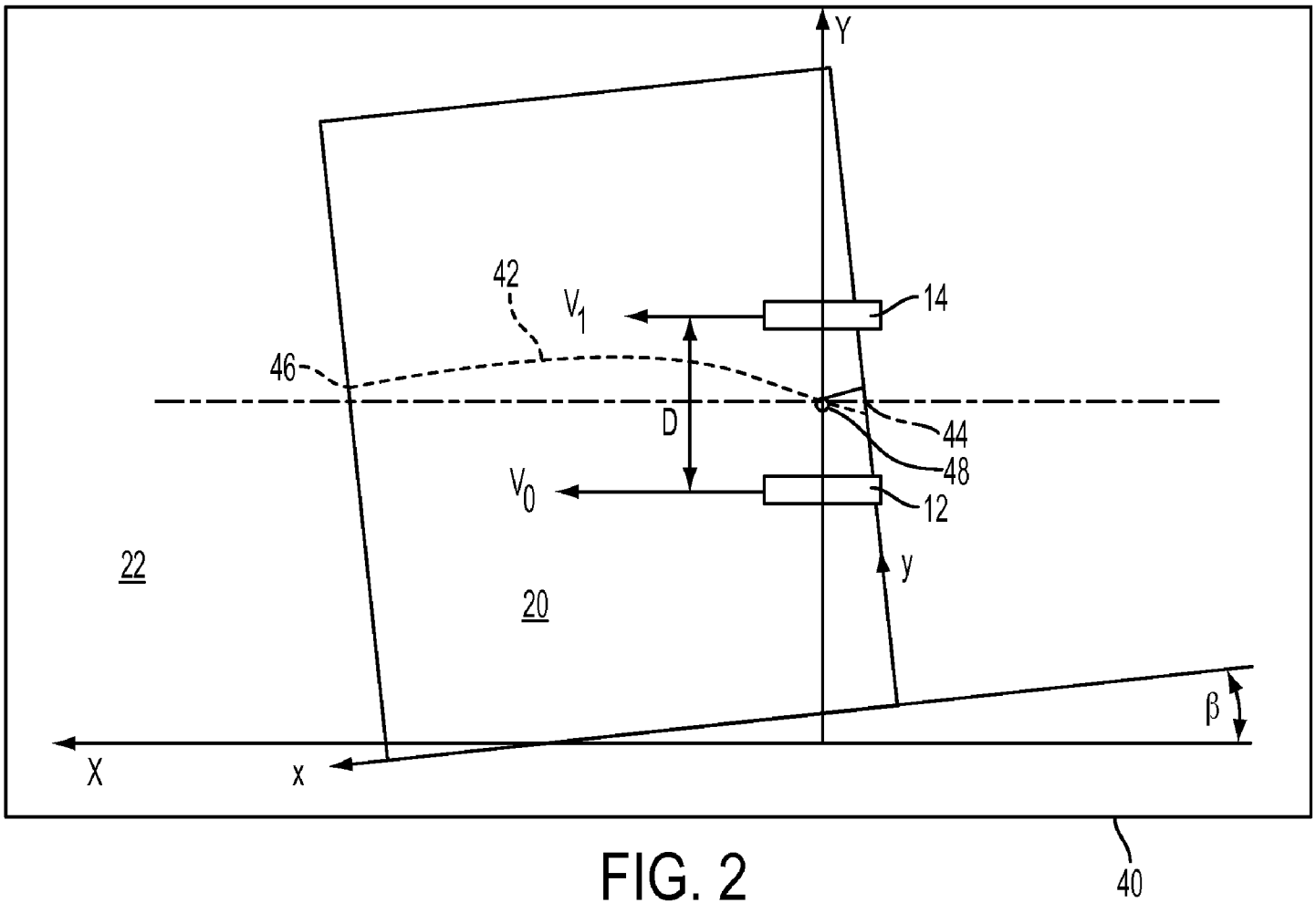
FIG. 2 PRIOR ART

The method, system, and printmaking device disclosed herein provide for performing closed loop lateral and skew control of a sheet using a single lateral sensor.

As used herein, the term "sheet" encompasses, for example, one or more of a usually flimsy physical sheet of paper, heavy media paper, coated papers, transparencies, parchment, film, fabric, plastic, or other suitable physical print media substrate on which information can be reproduced.

As used herein, the phrase "printmaking device" encompasses any apparatus, such as a digital copier, a bookmaking machine, a facsimile machine, and a multi-function machine, which performs a printing outputting function for any purpose.

As used herein, the phrase "feed path" encompasses any apparatus for separating and/or conveying one or more sheets into a substrate conveyance path inside a printmaking device.

As used herein, the phrase "process direction" refers to a direction that the feed path moves a sheet.

As used herein, the phrase "lead edge" refers to the edge of a sheet that first advances along the substrate conveyance path.

As used herein the phrase "printing module" refers to a marking device that uses marking technologies, such as xerographic, inkjet, and offset markings.

As used herein, the phrase "sensors" refer to a sensor that detects the position of a sheet edge. It may use intensity or brightness of light or other physical phenomena. For example, the sensor may be an optical sensor.

As used herein, the phrase "fixed reference" refers the alignment and configuration of the sensor, which points at a non-changing location to where the sensor collects information. The reference is a fixed reference because the sensor will only detect activity at the configured location. For example, a fixed reference may be a specific location on the feed path and the sensor may detect when a sheet is at that specific location.

As used herein, the term "skew" refers to an angular error in the placement of an image printed onto a sheet.

As used herein, the terms "register" and "registration" refer to determining the proper alignment of a sheet and/or a printing apparatus with respect to a fixed reference.

As used herein, the phrases "controller" and "registration controller" refer to a device capable of collecting data from sensors, analyzing data, and controlling movement of registration nips.

As used herein, the term "closed loop registration" refers to continuous or repeated monitoring and/or adjustment of a sheet during the registration of the sheet. Closed loop registration allows feedback to be obtained throughout the registration process to help ensure the sheet is being adjusted properly and/or remains on the correct path of movement.

As used herein, the term "open loop registration" refers to receiving an input and adjusting the sheet based on the input. No additional feedback is received after the input. For example, a system may measure and/or determine the position of the sheet at one instance during the registration process and adjust the sheet based on that one instance without receiving additional feedback or measurements thereafter.

Figure 3:
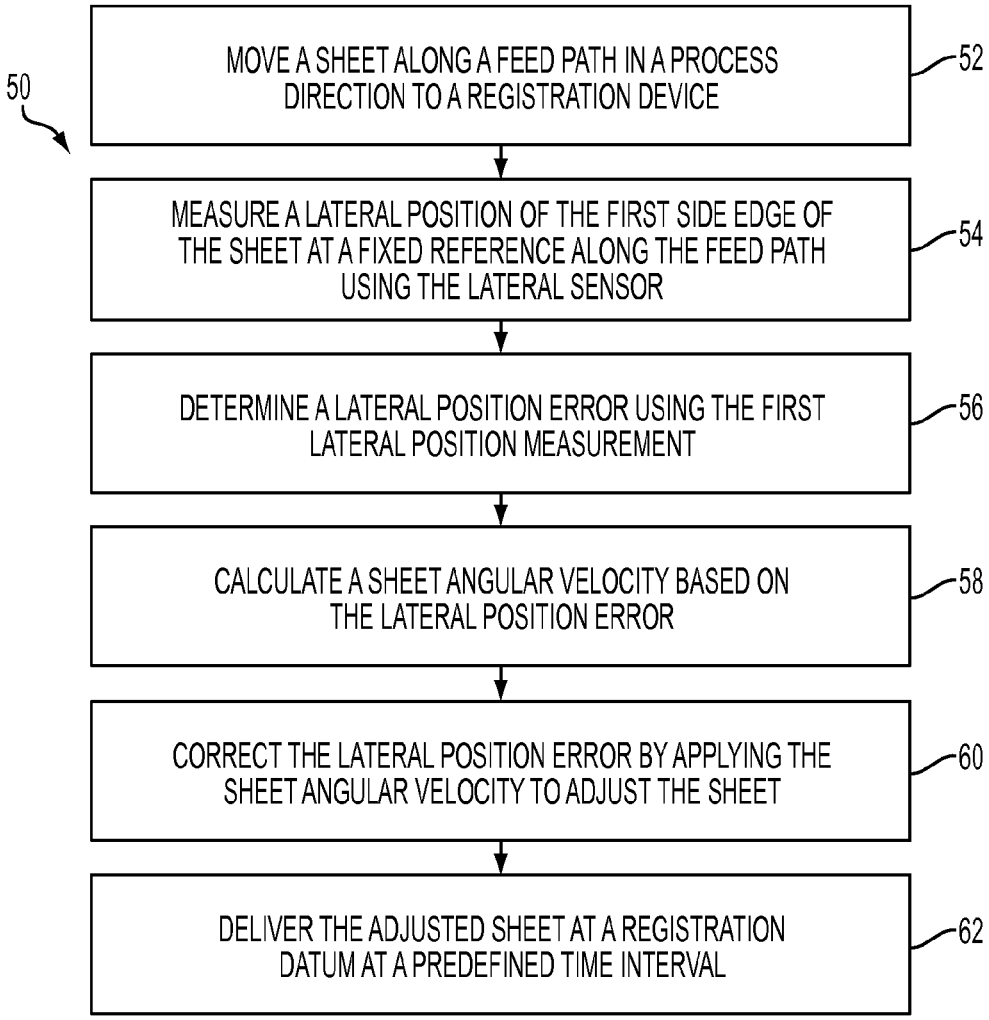
FIG. 3 illustrates a method for performing closed loop lateral and skew control of a sheet using a single lateral position sensor.

With reference to FIG. 3, a method 50 for closed loop lateral and skew control during registration of a sheet using a single lateral position sensor is provided. Step 52 moves a sheet along a feed path in a process direction to a sheet registration system. The sheet has a first edge, a second edge, and a first side edge and a second side edge therebetween. Next, step 54, measures a first lateral position of the first side edge of the sheet at a first fixed reference along the feed path using the lateral sensor, and a first lateral position error of the first side of the sheet is determined using the first lateral position measurement in step 56. The lateral sensor may be attached to a controller, for example, a closed loop lateral controller.

After that, step 58, calculates a sheet angular velocity based on the lateral position error. The sheet angular velocity may be calculated by the controller. The lateral position error is corrected in step 60 by applying the sheet angular velocity to adjust the sheet. The sheet may be adjusted using a pair of nips and/or using any method known to one skilled in the art. For example, if a pair of nips are used the speed of one or more of the nips may be increased and/or decreased in order to correct the lateral position error of the sheet. The method 50 may further be designed to measure the arrival time of the first side edge of the sheet at the fixed reference and adjust the process position to ensure that the sheet arrives at the registration datum within a designated time interval after the arrival time (i.e., "on time"), as shown in step 62.

The method 50 of FIG. 3 may further include the steps of inverting and refeeding the sheet on a second side and repeating the steps 52-62 on the second side of the sheet. When two-sided or duplex printing is being performed the arrival time of the first side edge of the sheet will be measured on both the first and second sides of the sheet, with each having a different arrival time, but the fixed reference may be two distinct fixed reference locations, i.e., a first and a second fixed reference, or the same fixed reference, depending on the registration system. Similarly, the registration datum for the first and second sides of the sheet may be two separate datums or the same datum, depending on the registration system.

The angular velocity may be calculated using any method known to one skilled in the art. The Examples of equations used to find the angular velocity, omega, include: (1) omega=(proportional gain)*(Y-direction error); (2) omega=(proportional gain)*(Y-direction error)+gain*(derivative of Y-direction error); and (3) omega=f (Y-direction error). Devices capable of calculating angular velocity based on the lateral position error include, but are not limited to, a proportional controller, or a Proportional Integral and Derivative (PID) controller. The method 50 of FIG. 3 and angular velocity equations are designed (but not limited to) to be used as a fine registration method, i.e., a method for correcting small errors in the lateral position of the sheet.

Moreover, it is contemplated that the method 50 may be used in combination with a coarse registration method. If used in combination with a coarse registration method, the sheet may be registered using a known registration method, such as an open loop lateral and skew registration method, prior to the initiation of the fine registration method 50 of FIG. 3. For example, after the coarse registration is completed, the sheet would proceed in the process direction to the fixed reference. Once the sheet reaches the fixed reference, the method 50 may be performed to determine and correct the lateral position error of the first side of the sheet.

As may be appreciated by one skilled in the art, the course registration method used to determine the correct position the sheet at a fine registration line may include one of the following known methods: determining a lateral position error by subtracting an actual lateral position from a desired lateral position; using a set of trapezoidal profiles; and/or using the angular velocity of the sheet relative to nips in a registration system to determine the sheet position error. U.S. Pat. No. 5,094,442 by Kamprath et al. U.S. Pat. Nos. 6,533,268 and 6,575,458 disclose alternative mechanisms for adjusting a sheet's lateral position with an appropriate actuator. These contemporary methods more generally disclose that the nip assemblies can be used to move the sheet in three degrees of freedom, i.e. process, lateral, and skew, in order to achieve proper sheet registration.

Figure 4:
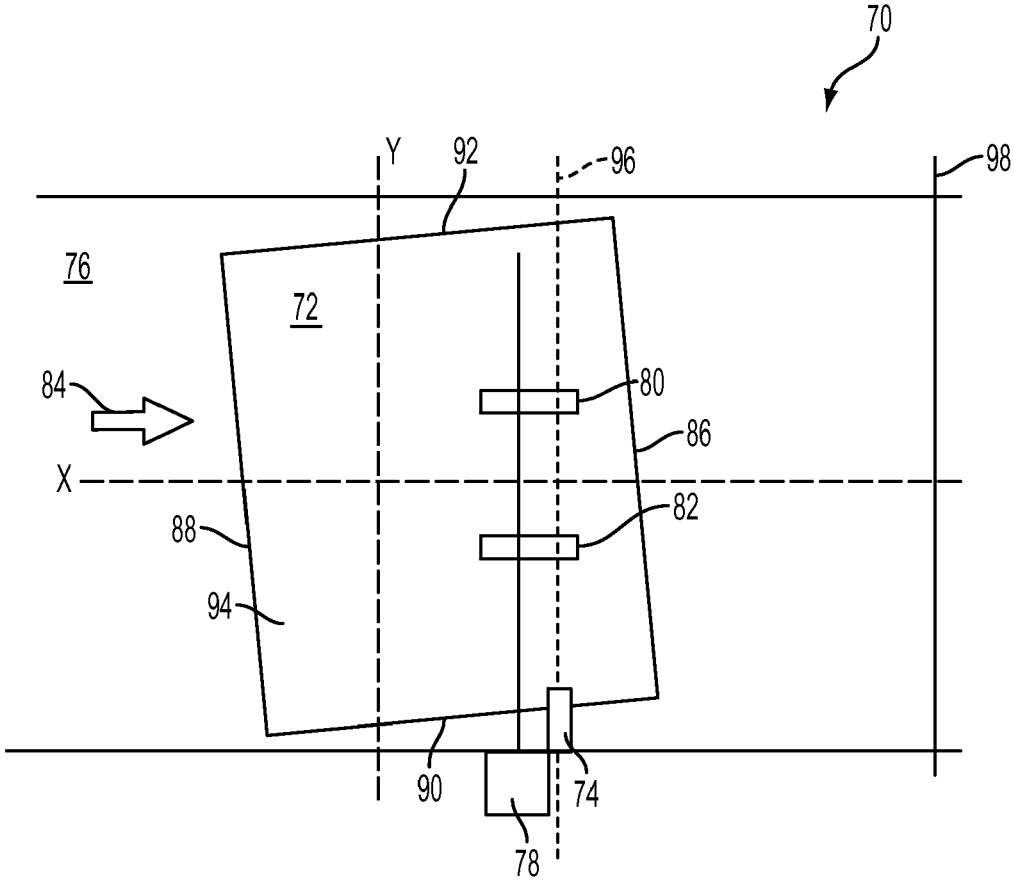
FIGS. 4-5 illustrate a system for use with the method of FIG. 3.

Referring to FIG. 4, a system 70 for use with the method 50 of FIG. 3 for performing closed loop lateral and skew control of a sheet 72 using a single lateral sensor 74 in a sheet registration system is provided. The system 70 includes a feed path 76, a lateral sensor 74, a registration controller 78, and at least one pair of registration nips, shown as one pair of nips 80, 82. The feed path 76 is configured to move the sheet 72 in a process direction 84. The sheet 72 having a first edge 86, a second edge 88, and a first side edge 90 and a second side edge 92 therebetween.

The lateral sensor 74 is configured to measure a lateral position of the first side edge 90 of the sheet 72 at a fixed reference 96 (or fine registration line) along the feed path 76 to determine a lateral position error of the first side 94 of the sheet 72. The lateral sensor 74 is operatively connected to the registration controller 78. The registration controller 78 is configured to calculate the sheet angular velocity. For example, the registration controller 78 may be a closed loop lateral controller, a proportional controller, or a proportional integral and derivative controller (PID).

The registration controller 78 is also operatively connected to the pair of registration nips 80, 82, which are located along the feed path 76. The pair of registration nips 80, 82 may adjust the sheet 72 by applying the sheet angular velocity to the sheet 72. For example, the sheet angular velocity may result in slowing down and/or speeding up the speed of one or more of the nips 80, 82 to correct the lateral position error.

In operation, the feed path 76 moves the first side 94 of the sheet 72 in a process direction 84 past the lateral sensor 74 and the first side 94 of the sheet 72 is registered. The registration is performed using the following steps. First, measuring the lateral position of the first side edge 90 of the sheet 72 at a first fixed reference 96 along the feed path 76 using the lateral sensor 74. After that, determining a first lateral position error of the first side 94 of the sheet 72 using the first lateral position measurement. Next, calculating a first sheet angular velocity based on the lateral position error. The first sheet angular velocity may be calculated by the registration controller 78. Then, correcting the lateral position error using the one pair of registration nips 80, 82 to adjust the sheet 72 by applying the first sheet angular velocity to the sheet 72. The registration may further include measuring the arrival time of the first side edge 90 of the sheet 72 at the first fixed reference 96 and adjusting the process position to ensure that the sheet 72 arrives at the registration datum 98 within a designated time interval after the arrival time.

Figure 5:
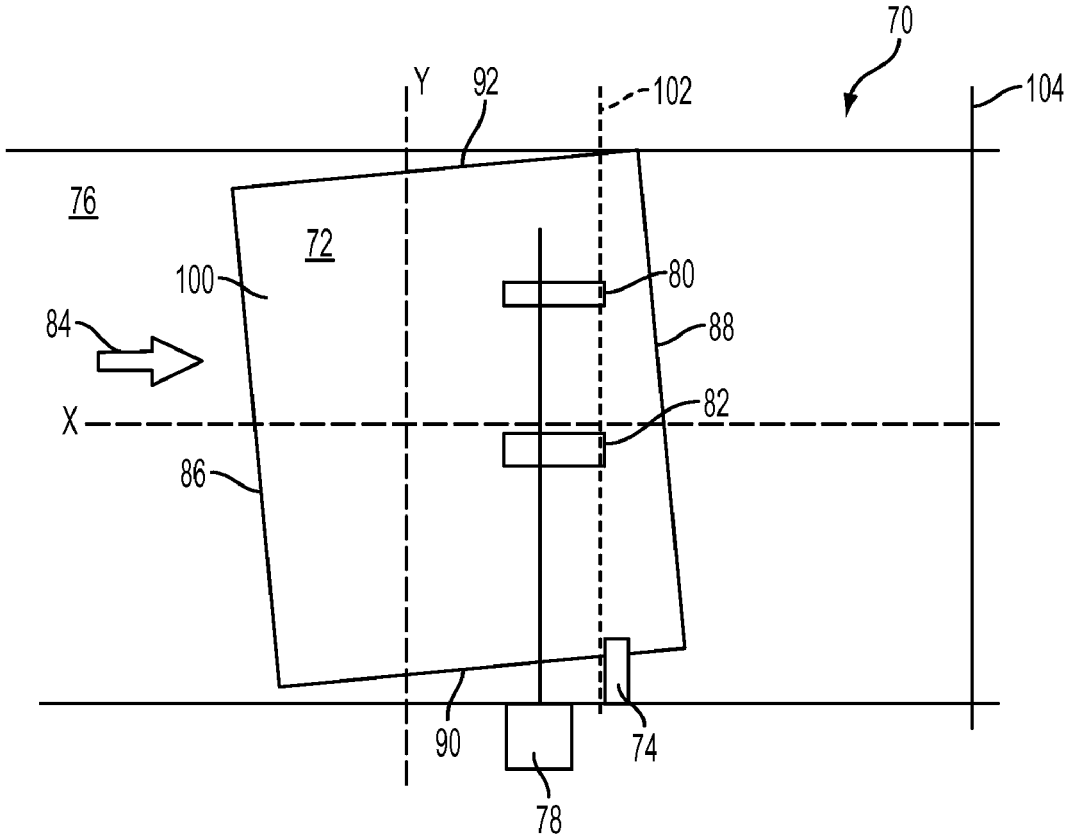

The system 70 may further be configured for two-sided or duplex printing, as shown in FIG. 5. During duplex printing, the system 70 inverts and refeeds the sheet 72 on a second side 100. The sheet 72 is shown being inverted such that the first side edge 90 of the sheet 72 remains along the same edge of the feed path 76. However, as one skilled in the art will appreciate, the sheet 72 may also be inverted such that the first side edge 90 and the second side edge 92 are switched. Although not shown herein, the system would operate in the same manner except opposing side edges 90, 92 would be measured during the duplex printing.

Once the sheet 72 is inverted and refed, the feed path 76 moves the second side 100 of the sheet 72 in the process direction 84 past the lateral sensor 74, and the second side 100 of the sheet 72 is registered. The second side 100 of the sheet 72 is registered by measuring a second lateral position of the first side edge 90 of the sheet 72 at a second fixed reference 102 along the feed path 76 using the lateral sensor 74, and determining a second lateral position error of the second side 100 of the sheet 72 using the second lateral position measurement. A second sheet angular velocity is calculated based on the second lateral position error using the registration controller 78. Then, the second sheet angular velocity is applied to the sheet 72 using the one pair of registration nips 80, 82 to adjust the sheet 72 to correct the lateral position error. After that, the registration may further include measuring the arrival time of the first side edge 90 of the sheet 72 at the second fixed reference 102 and adjusting the process position to ensure that the sheet 72 arrives at the registration datum 104 within a designated time interval after the arrival time.

When two-sided or duplex printing is being performed the fixed reference may include two distinct fixed reference locations, i.e., a first and a second fixed reference 96, 102, or the same fixed reference, depending on the system. Similarly, the registration datum for the first and second sides 94, 100 of the sheet 72 may be two separate datums 98, 104 or the same datum, depending on the printmaking device. As may be appreciated by one skilled in the art, the same lateral edge sensor 74 may be used to register both sides of the sheet 72 or a different lateral edge sensor 74 may be used to register each side of the sheet 72, depending on the system.

The system 70 of FIGS. 4-5, may further be configured to perform open loop lateral and skew registration prior to the sheet 72 reaching the first fixed reference 96. The lateral and skew registration may be performed using any method as will be appreciated by one skilled in the art. The performance of open loop lateral and skew registration may be performed during coarse registration as described above and be used to provide the sheet 72 to the system 70 in condition for fine registration as described herein.

Figure 6:
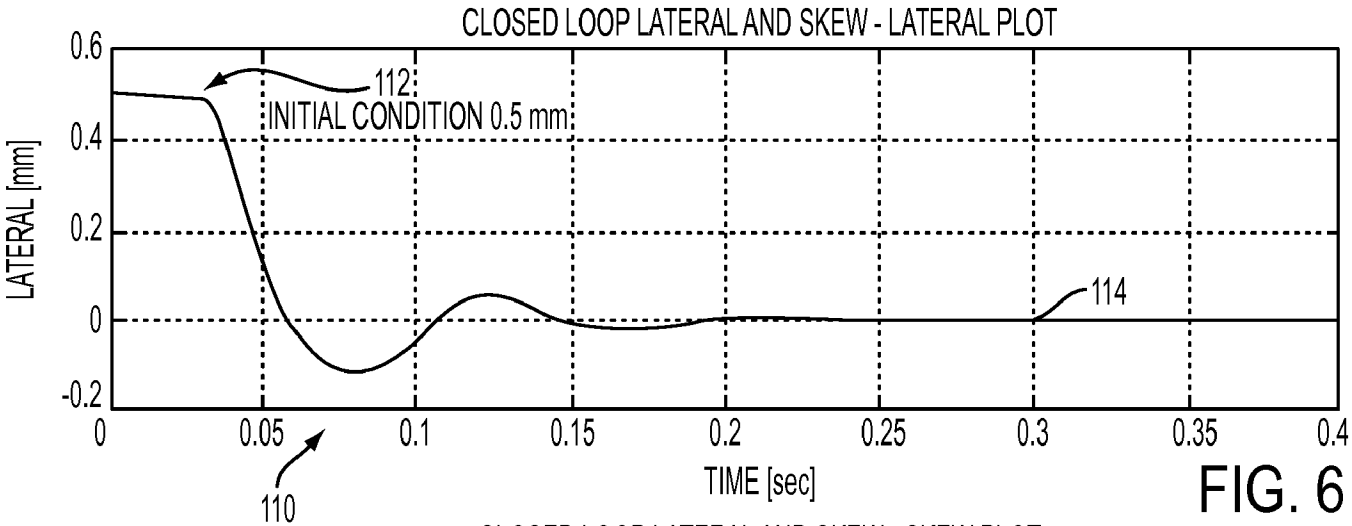
FIGS. 6-7 graph a simulation of the motion of the sheet with the lateral position and skew plotted as a function of time.
Figure 7:
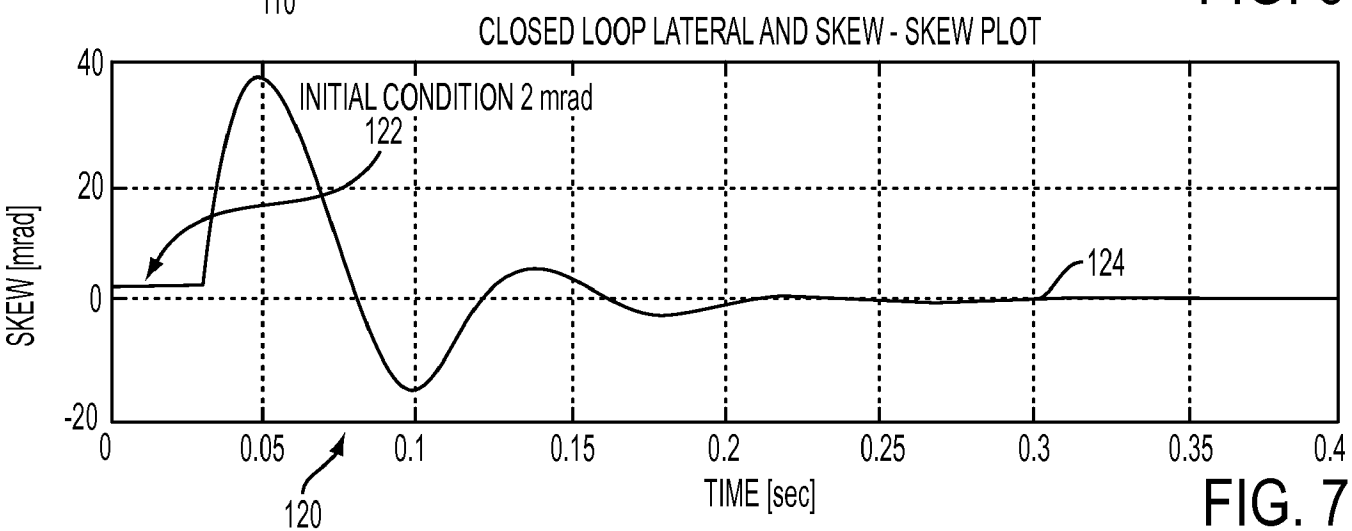

FIGS. 6-7 provide graphs 110, 120 that plot the lateral position and skew movement of a fixed portion of the sheet 72 as the method 50 of FIG. 3 corrects the lateral error of the sheet 72. Note how correction of the lateral position requires adjusting the skew of the sheet 72. In particular, FIG. 6 plots the lateral position measurements in millimeters (mm). The graph 110 shows the initial lateral position error as 0.5 mm prior to 0.05 seconds (112) and then shows the lateral position error as approximately 0.0 mm at 0.3 seconds (114). FIG. 7 plots the skew measurements in millirads (mrad). The graph 120 shows the initial skew as 2 mrad prior to 0.05 seconds (122), and then shows the skew as approximately 0.0 mrad at 0.3 seconds (124).

Figure 8:
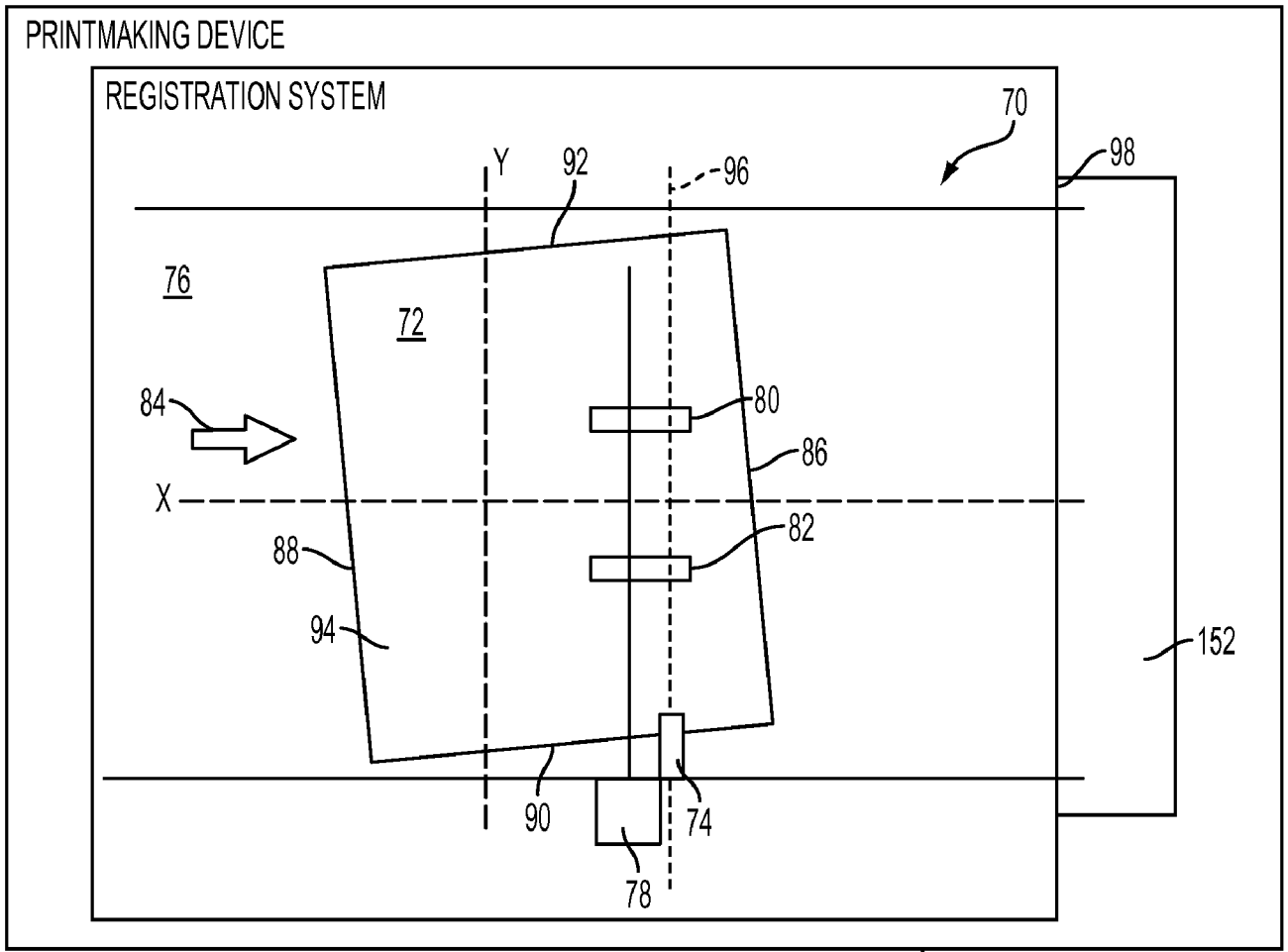
FIG. 8 provides an exemplary printmaking device for use with the method and system of FIGS. 3-4.
Figure 10:
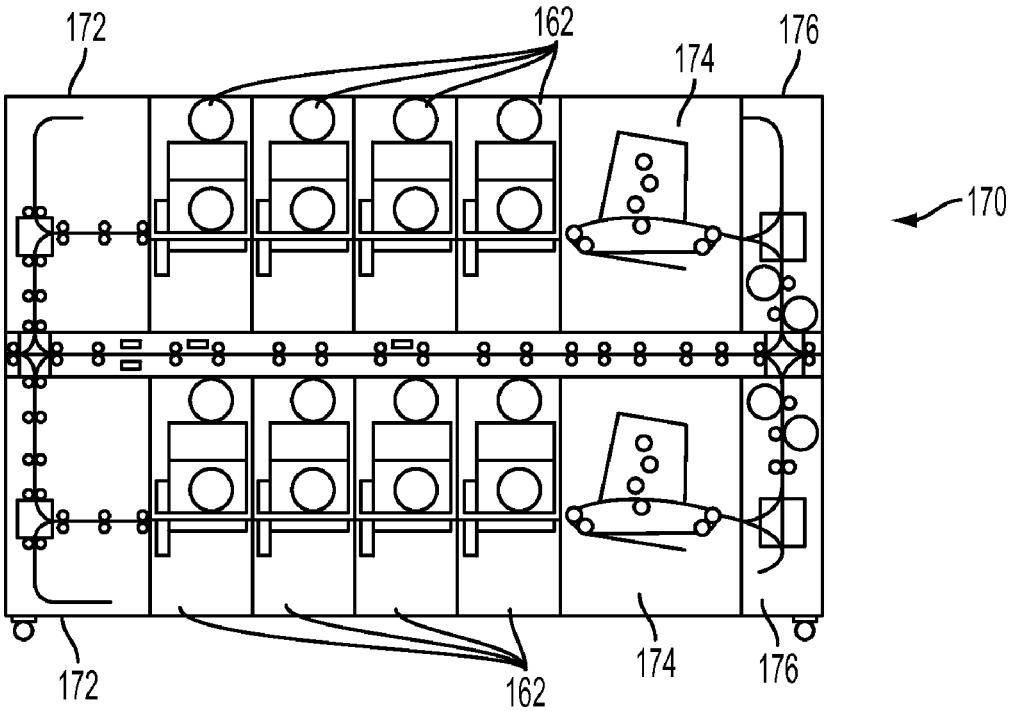
FIG. 10 provides an exemplary arrangement of multiple printing modules.

FIG. 8 provides a printmaking device 150 for use with the method 50 and system 70 of FIGS. 3-5. The printmaking device 150 includes a feed path 76, one or more printing modules 152, and a sheet registration system 70. The feed path 76 is adapted to move the sheet 72. The sheet 72 includes a first edge 86, a second edge 88 and a first side edge 90 and a second side edge 92 therebetween, where the first edge 86 is approximately parallel to the second edge 88. The printing module 152 is configured to print an image on the sheet 72. The printing module 152 may then send the sheet 72 to another printing module 152 as shown in FIG. 10, or move the sheet 72 along the feed path 76 in the printmaking device 150.

Prior to reaching the printmaking module 152, the feed path 76 moves the sheet 72 past the sheet registration system 70. The sheet registration system 70 includes a lateral sensor 74, a registration controller 78, and at least one pair of registration nips, shown as one pair of registration nips 80, 82. The feed path 76 is configured to move the sheet 72 in a process direction 84. The sheet 72 having a first edge 86, a second edge 88, and a first side edge 90 and a second side edge 92 therebetween.

The lateral sensor 74 is configured to measure a lateral position of the first side edge 90 of the sheet 72 at a fixed reference 96 (or fine registration line) along the feed path 76 to determine a lateral position error of the first side edge 90 of the sheet 72. The lateral sensor 74 is operatively connected to the registration controller 78. The registration controller 78 is configured to calculate the sheet angular velocity. For example, the registration controller 78 may be a closed loop lateral controller, a proportional controller, or a proportional integral and derivative controller (PID).

The registration controller 78 is also operatively connected to the pair of registration nips 80, 82, which are located along the feed path 76. The pair of registration nips 80, 82 may adjust the sheet 72 by applying the sheet angular velocity to the sheet 72. For example, the sheet angular velocity may result in slowing down and/or speeding up the speed of one and/or both of the nips 80, 82 to correct the lateral position error.

In operation, the feed path 76 moves the first side 94 of the sheet 72 in a process direction 84 past the lateral sensor 74 and a first side 94 of the sheet 72 is registered. The registration is performed using the following steps. First, measuring a first lateral position of the first side edge 90 of the sheet 72 at a first fixed reference 96 along the feed path 76 using the lateral sensor 74. After that, determining a lateral position error of the first side 94 of the sheet 72 using the first lateral position measurement. Next, calculating a first sheet angular velocity based on the first lateral position error. The first sheet angular velocity may be calculated by the registration controller. Then, correcting the lateral position error using the one pair of registration nips 80, 82 to adjust the sheet 72 by applying the first sheet angular velocity to the sheet 72. The registration may further include measuring the arrival time of the first side edge 90 of the sheet 72 at the first fixed reference 96 and adjusting the process position to ensure that the sheet 72 arrives at the registration datum 98 within a designated time interval after the arrival time.

The printmaking device 150 may further be configured for two-sided or duplex printing, using the system 70 as shown in FIG. 5. During duplex printing, the sheet 72 is inverted and refed on a second side 100. The feed path 76 moves the second side 100 of the sheet 72 in the process direction 84 past the lateral sensor 74 and the second side 100 of the sheet 72 is registered. The second side 100 of the sheet 72 is registered by measuring a second lateral position of the first side edge 90 of the sheet 72 at a second fixed reference 102 along the feed path 76 using the lateral sensor 74, and determining the second lateral position error of the second side 100 of the sheet 72 using the second lateral position measurement. A second sheet angular velocity is calculated based on the second lateral position error using the registration controller 78. Then, the second sheet angular velocity is applied to the sheet 72 using the one pair of registration nips 80, 82 to adjust the sheet 78 to correct the second lateral position error. After that, the registration may further include measuring the arrival time of the first side edge 90 of the sheet 72 at the second fixed reference 102 and adjusting the process position to ensure that the sheet 72 arrives at the registration datum 104 within a designated time interval after the arrival time.

When two-sided or duplex printing is being performed the arrival time of the first side edge 90 of the sheet 72 will be measured on both the first and second sides 94, 100 of the sheet 72, with each having a different arrival time. The fixed reference may also be two distinct fixed reference locations, i.e., a first and a second fixed reference 96, 102, or the same fixed reference, depending on the system. Similarly, the registration datum for the first and second sides 94, 100 of the sheet 72 may be two separate datums 98, 104 or the same datum, depending on the printmaking device. As may be appreciated by one skilled in the art, the same lateral edge sensor 74 may be used to register both sides of the sheet 72 or a different lateral edge sensor 74 may be used to register each side of the sheet 72, depending on the system.

The printmaking device 150 FIG. 8, may further be configured to perform open loop lateral and skew registration prior to the sheet 72 reaching the first fixed reference 96 of the sheet registration system 70. As will be appreciated by one skilled in the art, the lateral and skew registration may be performed using any known method. The performance of open loop lateral and skew registration may be performed during coarse registration as described above and be used to provide the sheet 72 to the system 70 in condition for fine registration as described herein.

Figure 9:
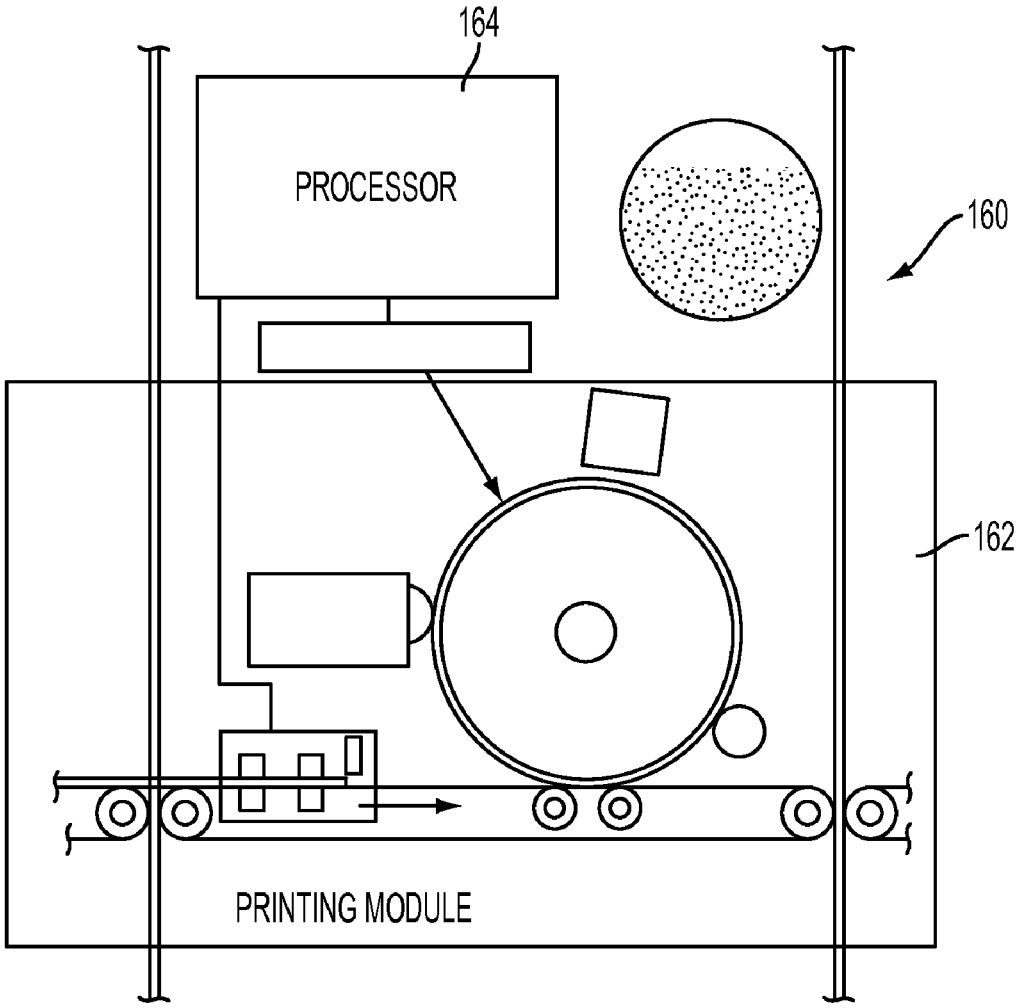
FIG. 9 provides an exemplary printing module for use in the printmaking device of FIG. 8.

The printmaking device 150 may further include one or more printing modules 152 for use with modular overprint systems in printmaking devices. FIGS. 9-10 provide examples of a printmaking devices 160, 170 with a printing module 162, which may be used with the method 50 and system 70 of FIGS. 3-5. See U.S. patent application Ser. No. 12/364,675, filed on Feb. 3, 2009, contents of which are incorporated herein by reference.

Specifically, FIG. 9 provides an example of a portion of the printmaking device 160 containing the printing module 162. The printing module 162 is connected to a processor 164 in the printmaking device, which may include and/or be operatively connected to a registration controller 78 as described herein. The printing module 162 is capable of printing on the sheet 72 and the processor 164 is capable of controlling the printmaking device 160 and/or printmaking module 162. The printing module 162 and the processor 164 are operatively connected to facilitate proper printing on the sheet 72.

FIG. 10 provides an example of a configuration of multiple printing modules 162 configured for use together with a printmaking device 170. In such configuration, each printing module 162 may include a structure forming a portion of the feed path 76 and printing hardware to place printing material of a predetermined type ("type" referring to color or some other attribute, such as MICR properties) on the sheet 72 passing through the feed path 76: in any other significant aspects, all printing modules 162 are substantially identical in design. In this way, by providing a given number of printing modules 162 along a common sheet path and providing different types of printing material in each printing module 162, the overall printing making device 170 can effectively be custom made.

For example, the design of FIG. 10 contains four printing modules 162, providing a "full color" printer, one with black toner and the others with cyan, magenta, and yellow toners respectively, may be provided. However, as will be appreciated by one skilled in the art additional types of toner for a hexachrome and/or other special-purpose printer may also be added to the configuration. Moreover a "stack" of two sets of printing modules 162, along with input modules 172, fuser modules 174, and sheet exit modules 176, for a high-productivity color printer may be provided.

The benefit of the method, system, and printmaking device provided herein include use of a single low cost lateral edge sensor to determine a lateral position error in a closed loop registration process. By using a single low cost sensor, this disclosure ensures that the sheet 72 is delivered to the registration datum at the proper time and position without requiring multiple expensive sensors. Moreover, since the single lateral sensor is used with a closed loop registration process, the sheet 72 is monitored to provide more accuracy than other open loop registration processes.

It will be appreciated that variations of the above-disclosed and other features and functions, or alternative thereof, may be desirably combined into many other different systems or applications. Various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. A printmaking device for performing closed loop lateral and skew control of a sheet using a single lateral sensor in a sheet registration system comprising:

a feed path adapted to move the sheet, the sheet including a first edge and a second edge, a first side edge and a second side edge, the first side edge and the second side edge each extending between the first edge and the second edge, wherein said first edge is approximately parallel to said second edge;

a printing module configured to print an image on the sheet; and a sheet registration system along said feed path including a lateral sensor being configured to measure a lateral position of said first side edge of the sheet at a fixed reference along said feed path to determine a lateral position error of said first side edge;

a registration controller operatively connected to said lateral sensor, the registration controller being configured to calculate an angular velocity to be applied to the sheet that is sufficient to correct the lateral position error in the sheet by reference to the lateral sensor alone; and at least one pair of registration nips along said feed path and operatively connected to said registration controller, said at least one pair of registration nips configured to apply said angular velocity to the sheet.

2. The printmaking device of claim 1, wherein said printmaking device inverts the sheet and refeeds the sheet on a second side into the feed path, and said feed path moves said second side of the sheet in a process direction past said lateral sensor and said registration controller registers said second side of the sheet.

3. The printmaking device of claim 1, wherein said registration controller applies said first sheet angular velocity to the sheet using the at least one pair of nips.

4. The printmaking device of claim 1, wherein said registration controller is a closed loop lateral controller that calculates said first sheet angular velocity as a function of said first lateral position error.

5. The printmaking device of claim 1, wherein said registration controller is a proportional controller.

6. The printmaking device of claim 1, wherein said registration controller is a Proportional Integral and Derivative controller.

7. The printmaking device of claim 1, wherein the sheet registration system performs open loop lateral and skew registration prior to the sheet reaching said first fixed reference.

8. The printmaking device of claim 1, wherein the registration of said first side of the sheet further includes measuring a first arrival time of the sheet at said first fixed reference and delivering the adjusted sheet to a first registration datum at a first predefined time interval from said first arrival time.

9. A method for performing closed loop lateral and skew control of a sheet using a single lateral sensor in a sheet registration system comprising:

moving the sheet along a feed path in a process direction to the sheet registration system, the sheet having a first edge and a second edge, a first side edge and a second side edge, the first side edge and the second side edge each extending between the first edge and the second edge;

measuring a first lateral position of said first side edge of the sheet at a first fixed reference along said feed path using said lateral sensor;

determining a first lateral position error of said first side of the sheet using said first lateral position measurement;

calculating a first sheet angular velocity sufficient to correct the first lateral position error in the sheet by reference to the lateral sensor alone; and correcting said first lateral position error by applying said first sheet angular velocity to adjust the sheet.

10. The method of claim 9, further comprising the steps of:

inverting and refeeding the sheet on a second side;

moving the sheet along a feed path in the process direction to the sheet registration system;

measuring a second lateral position of said first side edge of the sheet at a second fixed reference along said feed path using said lateral sensor;

determining a second lateral position error of said second side of the sheet using said second lateral position measurement;

calculating a second sheet angular velocity sufficient to correct the second lateral position error in the sheet by reference to the lateral sensor alone; and correcting said second lateral position error by applying said second sheet angular velocity to adjust the sheet.

11. The method of claim 9, wherein the sheet registration system performs open loop lateral and skew registration prior to the sheet reaching said first fixed reference.

12. The method of claim 9, wherein said lateral sensor is attached to a registration controller.

13. The method of claim 9, wherein said registration controller is a closed loop lateral controller that calculates said first sheet angular velocity as a function of said first lateral position error.

14. The method of claim 9, wherein said registration controller applies said first sheet angular velocity to the sheet using a pair of nips.

15. The method of claim 9, wherein said registration controller is a proportional controller.

16. The method of claim 9, wherein said registration controller is a Proportional Integral and Derivative controller.

17. The method of claim 9, further comprising measuring a first arrival time of the first side of the sheet at said first fixed reference and delivering the adjusted sheet to a first registration datum at a first predefined time interval from said first arrival time.

18. A system for performing closed loop lateral and skew control of a sheet using a single lateral sensor comprising:

a feed path configured to move the sheet in a process direction, the sheet having a first edge and a second edge, a first side edge and a second side edge, the first side edge and the second side edge each extending between the first edge and the second edge;

a lateral sensor configured to measure a lateral position of said first side edge of the sheet at a fixed reference along said feed path to determine a lateral position error of said first side edge, a registration controller operatively connected to said lateral sensor, the registration controller being configured to calculate an angular velocity sufficient to correct the lateral position error in the sheet by reference to the lateral sensor alone; and at least one pair of registration nips along the feed path and operatively connected to said registration controller, said at least one pair of registration nips configured to apply said angular velocity to the sheet.

19. The system of claim 18, wherein said system inverts the sheet and refeeds the sheet on a second side into the feed path, and said feed path moves said second side of the sheet in a process direction past said lateral sensor and said registration controller registers said second side of the sheet.

20. The system of claim 18, wherein said registration controller applies said first sheet angular velocity to the sheet using the at least one pair of nips.

21. The system of claim 18, wherein said registration controller is a closed loop lateral controller that calculates said first sheet angular velocity as a function of said first lateral position error.

22. The system of claim 18, wherein said registration controller is a proportional controller.

23. The system of claim 18, wherein said registration controller is a Proportional Integral and Derivative controller.

24. The system of claim 18, wherein open loop lateral and skew registration is performed prior to the sheet reaching said first fixed reference.

25. The system of claim 18, wherein the registration of said first side of the sheet further includes measuring a first arrival time of the sheet at said first fixed reference and delivering the adjusted sheet to a first registration datum at a first predefined time interval from said first arrival time.

* * * * *